US008364071B2

(12) United States Patent
Noguchi et al.

(10) Patent No.: US 8,364,071 B2
(45) Date of Patent: Jan. 29, 2013

(54) IMAGE FORMING APPARATUS AND SHEET CONVEYING DEVICE HAVING UPSTREAM AND DOWNSTREAM ROLLERS

(75) Inventors: Hidetaka Noguchi, Kanagawa (JP); Toshiyuki Andoh, Kanagawa (JP); Seiji Hoshino, Kanagawa (JP); Takashi Hodoshima, Kanagawa (JP); Tatsuhiko Oikawa, Kanagawa (JP); Hiromichi Matsuda, Kanagawa (JP); Makoto Komatsu, Kanagawa (JP); Takashi Hashimoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 884 days.

(21) Appl. No.: 12/076,712

(22) Filed: Mar. 21, 2008

(65) Prior Publication Data

US 2008/0232880 A1 Sep. 25, 2008

(30) Foreign Application Priority Data

Mar. 22, 2007 (JP) ..... 2007-074551
Nov. 6, 2007 (JP) ..... 2007-288547

(51) Int. Cl.
*G03G 15/00* (2006.01)

(52) U.S. Cl. ..... 399/397; 399/66; 399/68; 399/122; 399/400

(58) Field of Classification Search ..... 399/67, 399/122, 307, 397, 396, 167, 68, 400, 66, 399/388; 271/270; 347/104
See application file for complete search history.

(56) References Cited

U.S. PATENT DOCUMENTS

| | | | | |
|---|---|---|---|---|
| 4,331,328 | A * | 5/1982 | Fasig | 271/270 |
| 5,519,478 | A | 5/1996 | Malachowski | |
| 6,097,920 | A * | 8/2000 | Hara et al. | 399/302 |
| 6,446,960 | B1 * | 9/2002 | Okada | 271/240 |
| 6,530,569 | B2 * | 3/2003 | Yamagishi | 271/270 |
| 2006/0246212 | A1 * | 11/2006 | Takahashi et al. | 427/8 |

FOREIGN PATENT DOCUMENTS

| | | |
|---|---|---|
| JP | 8-227241 | 9/1996 |
| JP | 08-254924 | 10/1996 |
| JP | 2001-346397 | 12/2001 |
| JP | 2004-054120 | 2/2004 |
| JP | 2004-109706 | 4/2004 |
| JP | 2005-107118 | 4/2005 |
| JP | 2006-085153 | 3/2006 |
| JP | 2003-215870 | 7/2006 |
| JP | 2006-259208 | 9/2006 |

OTHER PUBLICATIONS

Japanese Office Action mailed May 1, 2012.

* cited by examiner

*Primary Examiner* — Matthew G Marini
(74) *Attorney, Agent, or Firm* — Harness, Dickey & Pierce, P.L.C.

(57) ABSTRACT

A sheet conveying device includes a pair of upstream rollers and a pair of downstream rollers each including a drive roller and a driven roller, a calculating unit, and a control unit. The upstream rollers include a measuring unit that obtains speed information of the upstream rollers. The calculating unit calculates a target value based on the speed information. The control unit controls the speed of the drive roller of the downstream rollers based on the target value.

20 Claims, 11 Drawing Sheets

STORED DATA

OFFSET REMOVAL

ADDITION OF 0

POSITIVE AND NEGATIVE REVERSE

IMAGE FORMING APPARATUS AND SHEET CONVEYING DEVICE HAVING UPSTREAM AND DOWNSTREAM ROLLERS

CROSS-REFERENCE TO RELATED APPLICATIONS

The present application claims priority to and incorporates by reference the entire contents of Japanese priority documents 2007-074551 filed in Japan on Mar. 22, 2007 and 2007-288547 filed in Japan on Nov. 6, 2007.

BACKGROUND OF THE INVENTION

1. Field of the Invention

The present invention relates to a sheet conveying device and an image forming apparatus.

2. Description of the Related Art

Intermediate transfer type color image forming apparatuses are widespread in use. In such image forming apparatuses, a toner image each formed on a photosensitive element is primarily transferred onto an intermediate transfer member, and a color image on the intermediate transfer member is secondarily transferred onto a recording medium (sheet). The image forming apparatuses can be used for various types of sheet media such as thin sheet, thick sheet, postcard, and envelope, and therefore has an advantage of having high versatility. As the intermediate transfer member, an intermediate transfer drum or an intermediate transfer belt is generally used.

However, when a sheet with a certain level of thickness enters into a secondary transfer unit, the speed of the intermediate transfer member being driven at a certain speed drops for a short period of time. This disturbs image forming operation in the primary transfer unit.

Furthermore, along with downsizing of color image forming apparatuses, the secondary transfer unit and a fuser become adjacent to each other, and transfer and fixation of the image can be performed simultaneously on the sheet (when fixation is performed at a front end of one sheet, the image is transferred to a rear end of the sheet). At this time, when a sheet with a certain level of thickness enters into the fuser, the speed of a fuser roller or a fuser belt being driven at a certain speed drops for a short period of time. This disturbs image forming operation in the secondary transfer unit as in the intermediate transfer unit.

There is an image forming apparatus adopting a simultaneous transfer and fixing method in which transfer and fixation of the toner image onto the sheet is performed simultaneously (at a time). In this case also, when a sheet with a certain level of thickness enters into a transfer-fixing unit, the speed of the intermediate transfer member being driven at a certain speed drops for a short period of time, thereby causing a problem that the image is disturbed in the primary and secondary transfer units, as at the time of entering into the secondary transfer unit.

Japanese Patent Application Laid-open No. 2005-107118 discloses a conventional color image forming apparatus, in which the speed of a belt is made constant by changing a speed control amount with respect to a driving source of an endless belt at a preset predetermined timing, by a predetermined amount, and for predetermined duration.

In the conventional image forming apparatus, however, a unit that detects a mechanical property of a sheet such as a thickness sensor is required.

Moreover, because a control target value preset based on the type, thickness and width of a sheet is used, it is difficult to perform optimum control with respect to all usable sheets. Furthermore, even with the same sheet, the thickness and firmness change according to environmental conditions such as temperature and humidity, and fluctuation of speed caused thereby is different, and therefore, optimum control is difficult to perform.

Besides, it is required to store control target values corresponding to various types of sheets. With an increase in the type of sheets that can be handled, a storage unit is required to have a larger memory capacity.

SUMMARY OF THE INVENTION

It is an object of the present invention to at least partially solve the problems in the conventional technology.

According to an aspect of the present invention, there is provided a sheet conveying device that includes a plurality of conveying units each including a drive roller and a driven roller to convey a recording medium while holding the recording medium between the drive roller and the driven roller, the conveying units including a first conveying unit and a second conveying unit located downstream of the first conveying unit in a conveying direction in which the recording medium is conveyed, speed of the drive roller of the second conveying unit being controllable; a measuring unit that obtains speed information of the first conveying unit; a storage unit that stores therein the speed information; and a calculating unit that calculates a target value based on the speed information stored in the storage unit. The speed of the drive roller of the second conveying unit is controlled based on the target value.

According to another aspect of the present invention, there is provided an image forming apparatus including a sheet conveying device. The sheet conveying device includes a plurality of conveying units each including a drive roller and a driven roller to convey a recording medium while holding the recording medium between the drive roller and the driven roller, the conveying units including a first conveying unit and a second conveying unit located downstream of the first conveying unit in a conveying direction in which the recording medium is conveyed, speed of the drive roller of the second conveying unit being controllable; a measuring unit that obtains speed information of the first conveying unit; a storage unit that stores therein the speed information; and a calculating unit that calculates a target value based on the speed information stored in the storage unit. The speed of the drive roller of the second conveying unit is controlled based on the target value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
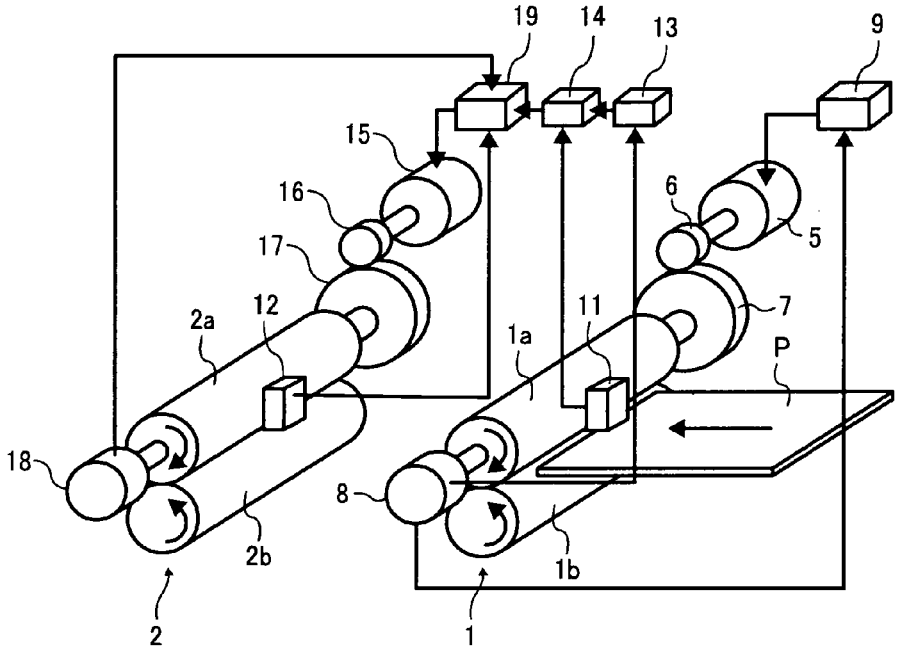
FIG. 1 is a schematic diagram of a sheet conveying device according to a first embodiment of the present invention.

FIG. 1 is a schematic diagram of a sheet conveying device according to a first embodiment of the present invention. The sheet conveying device of the first embodiment includes a pair of upstream rollers 1 as a first sheet conveying unit and a pair of downstream rollers 2 as a second sheet conveying unit. The pairs of rollers 1 and 2 each includes a drive roller 1*a* and a driven roller 1*b*, a drive roller 2*a* and a driven roller 2*b*. Sheet detectors 11 and 12 are respectively arranged near this side of the pairs of rollers 1 and 2. A recording medium (sheet) P is held between each pair of rollers 1 and 2, and conveyed from right to left in FIG. 1. The sheet conveying device can include three or more sheet conveying units.

The drive roller la in the upstream rollers 1 is driven by a motor (driving source) 5 via a small-diameter gear 6 and a large-diameter gear 7. The driven roller 1*b* is pressed by the drive roller 1*a* to rotate together therewith. A speed measuring unit 8 is attached to a shaft of the drive roller 1*a*. An output from the speed measuring unit 8 is sent to a controller 9 that controls the motor 5.

The drive roller 2*a* in the downstream rollers 2 is driven by a motor (driving source) 15 via a small-diameter gear 16 and a large-diameter gear 17. The driven roller 2*b* is pressed by the drive roller 2*a* to rotate together therewith. A speed measuring unit 18 is attached to a shaft of the drive roller 2*a*. An output from the speed measuring unit 18 is sent to a controller 19 that controls the motor 15.

The output of the speed measuring unit 8 in the upstream rollers is sent to a storage unit 13, and an output of the sheet detector 11 is sent to a calculating unit 14. An output of the sheet detector 12 in the downstream rollers is sent to the controller 19.

The drive rollers 1*a* and 2*a* and the driven rollers 1*b* and 2*b* in the sheet conveying device according to the first embodiment are made of metal; however, a roller surface can be coated with an organic material.

For the motors 5 and 15 as the driving source, a direct current (DC) motor, a pulse motor, an ultrasonic motor, or a direct drive motor can be used.

In the sheet conveying device according to the first embodiment, a drive transmission system from each driving source to each drive roller is formed of a gear. However, the drive transmission system can be formed of a gear and a synchronous belt, a V-belt and a pulley, or a planetary gear. When the ultrasonic motor or the direct drive motor is used for the driving source, the roller can be directly driven without using the drive transmission system in terms of the characteristics of these motors.

The controller 9 includes a feedback controller and a phase compensator. The feedback controller calculates drive voltage, drive current, and drive frequency of the driving source 5 based on the speed information of the drive roller 1*a* measured by the speed measuring unit 8, to control the driving source 5. The fed back speed information can be rotation speed information of the driven roller 1*b* or the driving source 5.

When the driving source 5 is the DC motor or the direct drive motor, a drive-current control method or a drive-voltage pulse-width-modulation (PWM) control method is used. When the driving source 5 is the pulse motor or the ultrasonic motor, a drive-frequency control method is used. The same applies to the driving source 15.

The speed measuring unit 8 can use a method of using a rotary encoder installed coaxially with the roller shaft, a method of directly measuring the surface speed of the roller by laser Doppler, or a method of using a magnetic encoder that measures magnetic information of a rotor of the motor by a magnetic sensor. When the motor as the driving source is the DC motor, a frequency generator (FG) signal output from the motor can be used. Alternatively, the drive current of the DC motor can be measured. The same thing applies to the speed measuring unit 18.

When the pulse motor or the ultrasonic motor is used for the driving source 5, the motor can be driven only by open-loop control without performing the feedback control. The phase compensator adjusts a control band and gain.

Figure 2:
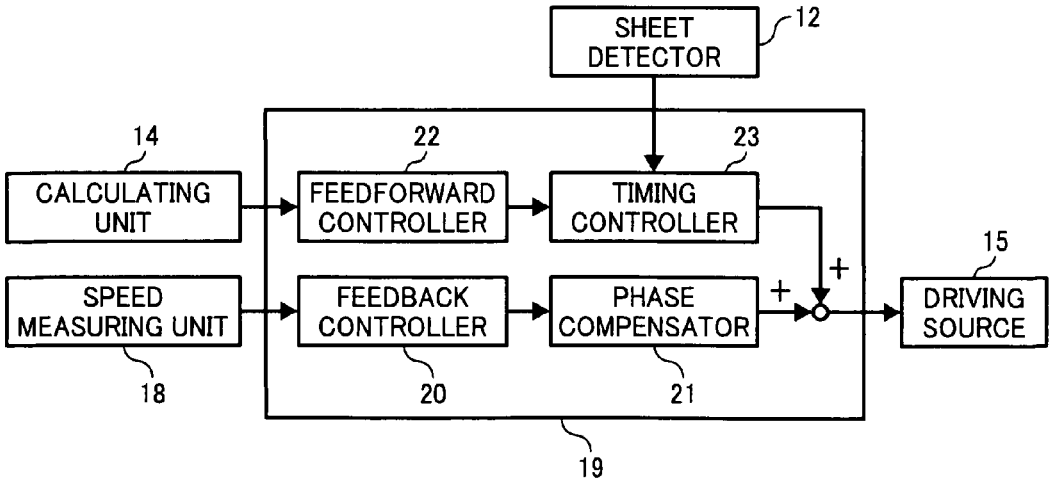
FIG. 2 is a functional block diagram of a controller of a pair of downstream rollers shown in FIG. 1.

FIG. 2 is a functional block diagram of the controller 19. The controller 19 includes a feedback controller 20, a phase compensator 21, a feedforward controller 22, and a timing controller 23. The feedback controller 20 and the phase compensator 21 are of basically the same configuration and operate in the same manner as those in the controller 9, and the same explanation is not repeated.

The feedforward controller 22 converts the control target value obtained by the calculating unit 14 to a control command value, for example, expressed by voltage, current, or frequency of the driving source (described in detail later).

The timing controller 23 gives time delay to the command value output from the feedforward controller 22 and outputs the delayed command value. The delay time is from detection of the sheet P by the sheet detector 12 until the sheet P enters into a pressed part between the drive roller 2*a* and the driven roller 2*b*. The sheet can be detected without the sheet detector 12 by using a drive signal or speed fluctuation information of the upstream rollers 1.

Figure 3:
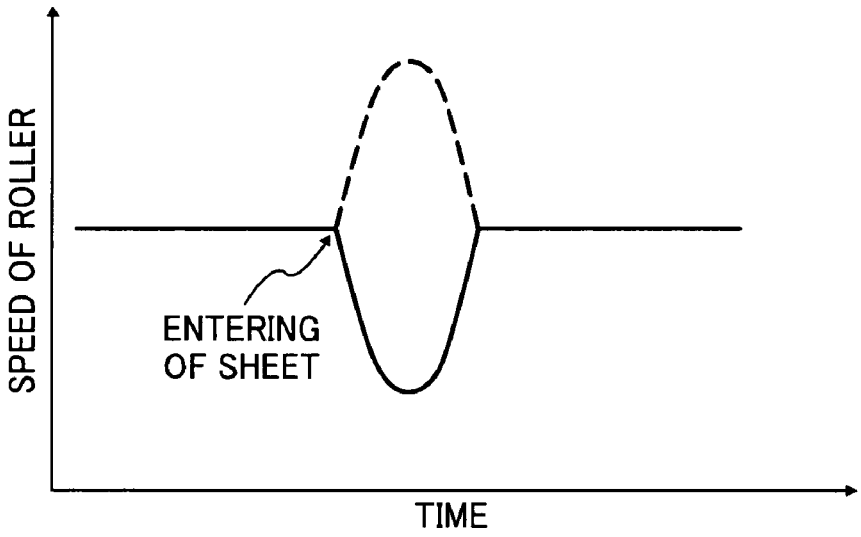
FIG. 3 is a conceptual diagram of a control method according to the first embodiment.

FIG. 3 is a conceptual diagram of a control method according to the first embodiment. When a sheet with a certain level of thickness enters into the pair of rollers, the speed of the rollers being driven at a predetermined speed fluctuates. That is, as indicated by solid line in FIG. 3, the speed of the downstream rollers 2 drops for a short period of time. To negate such fluctuation of speed, the drive roller 2*a* is driven as indicated by broken line in FIG. 3 at timing when a sheet enters into the rollers 2. By driving the drive roller 2*a* in this manner, fluctuation of speed due to entering of a sheet can be negated. A control target value for driving the drive roller 2*a* in the downstream rollers 2 is obtained, as indicated by broken line in FIG. 3, based on (by detecting) fluctuation of speed of the upstream rollers 1.

Figure 4:
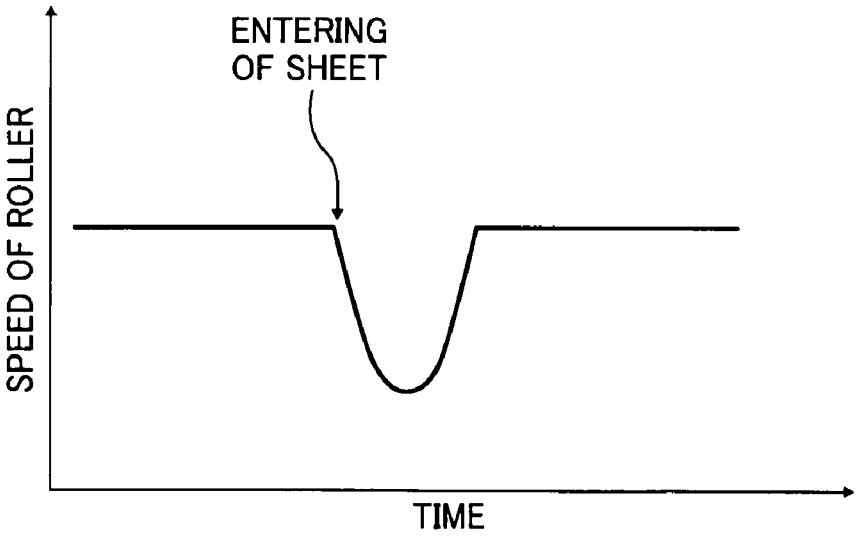
FIG. 4 is a diagram for explaining fluctuation of speed of a drive roller when a sheet with a certain thickness enters into a pair of upstream rollers shown in FIG. 1.

A specific control method is explained below. FIG. 4 is a diagram for explaining fluctuation of speed of the drive roller la when a sheet with a certain thickness enters into the upstream rollers 1. When the same sheet enters into the downstream rollers 2, speed fluctuation occurs in the same manner as shown in FIG. 4. Therefore, by obtaining the speed fluctuation information of the upstream rollers 1, the control target value for negating fluctuation of speed of the downstream rollers 2 can be obtained. In the first embodiment, the rotation speed of the drive roller 1*a* is measured to obtain the speed information of the upstream rollers 1. However, rotation speed information of the driven roller 1*b* or the driving source 5 can be also used.

To calculate the control command value easily, it is preferable that the upstream rollers 1 and the downstream rollers 2 have the same configuration. However, if the configuration is different from each other, an appropriate control command value can be calculated by a method described below.

When a sheet is held by both the upstream rollers 1 and downstream rollers 2, the entering condition of the sheet can be changed, respectively, in the upstream rollers 1 and the downstream rollers 2. Therefore, it is desired to arrange the upstream rollers 1 and the downstream rollers 2 away from each other by more than the sheet length to be used. In this case, a sheet conveying unit is separately required for conveying the sheet between the respective pairs. It is preferable that the sheet conveying unit have the same configuration.

Figure 5:
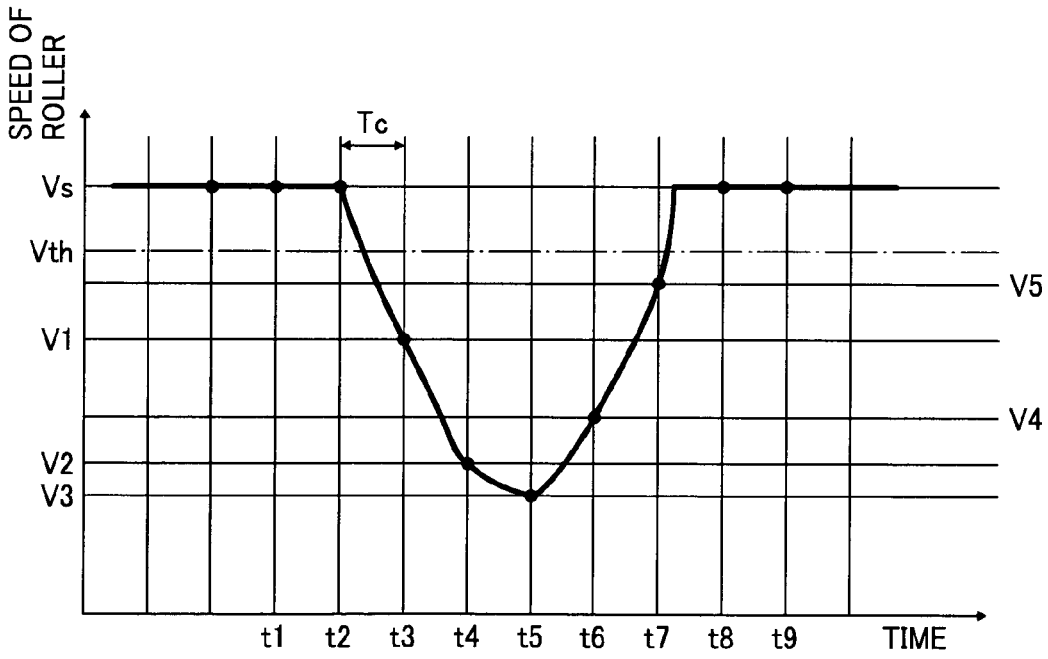
FIG. 5 is a graph for explaining how to obtain speed fluctuation information of the upstream rollers.

FIG. 5 is a graph for explaining how to obtain the speed fluctuation information of the upstream rollers 1. In FIG. 5, the rotation speed of the drive roller la is plotted on Y axis, and time is plotted on X axis. Besides, Vs denotes rotation speed of the drive roller la in a steady state, Vth denotes a threshold, and speed measurement is performed at a cycle Tc. The speed information is stored in the storage unit 13 only in a period during which the measured speed falls below Vth.

In the example of FIG. 5, V1, V2, V3, V4, and V5 for time t3 to t7 are stored in the storage unit 13. As the cycle Tc becomes shorter, more accurate speed information can be obtained. However, the number of stored data increases. For example, when linear velocity of the drive roller 1*a* is 200 mm/s, the actual speed fluctuation of the drive roller occurs in a period of from several milliseconds to several tens milliseconds. When the speed is measured by designating 1 millisecond as Tc, several to several tens data can be obtained. The cycle Tc can be changed according to the rotation speed of the roller.

The calculating unit 14 converts the speed information stored in the storage unit 13 to a control target value. FIGS. 6A to 6D are diagrams for explaining a procedure of converting speed information to a control target value.

Figure 6A:
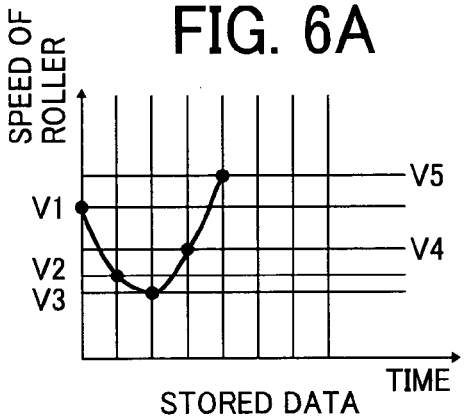
FIGS. 6A to 6D are diagrams for explaining a procedure of converting speed information to a control target value.
Figure 6B:
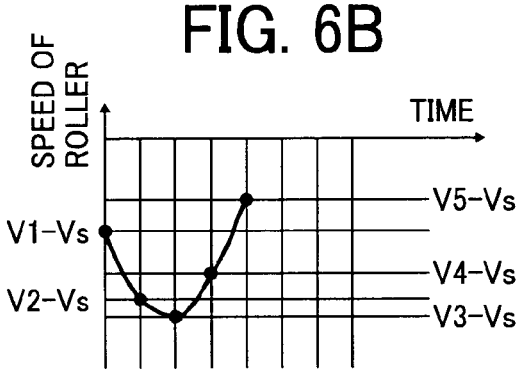
Figure 6C:
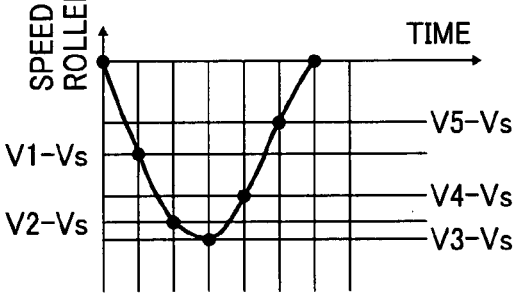
Figure 6D:
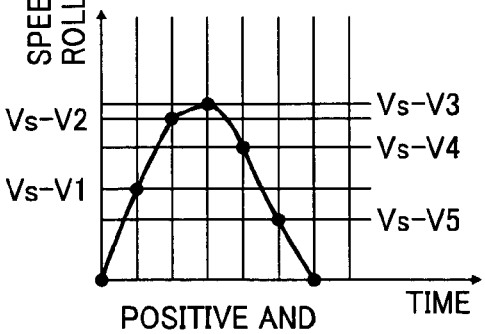

First, Vs is subtracted from the stored data V1 to V5 to remove an offset in the steady state as shown in FIG. 6B. Then, as shown in FIG. 6C, 0 is added before and after the data, for which offset removal has been performed. When positive and negative are reversed by multiplying these data by −1 as shown in FIG. 6D, the control target value is generated. The control target value obtained by the calculating unit 14 is sent to the feedforward controller 22 in the controller 19.

A conversion method from the control target value to the control command value in the feedforward controller 22 is explained below in detail.

Figure 7:
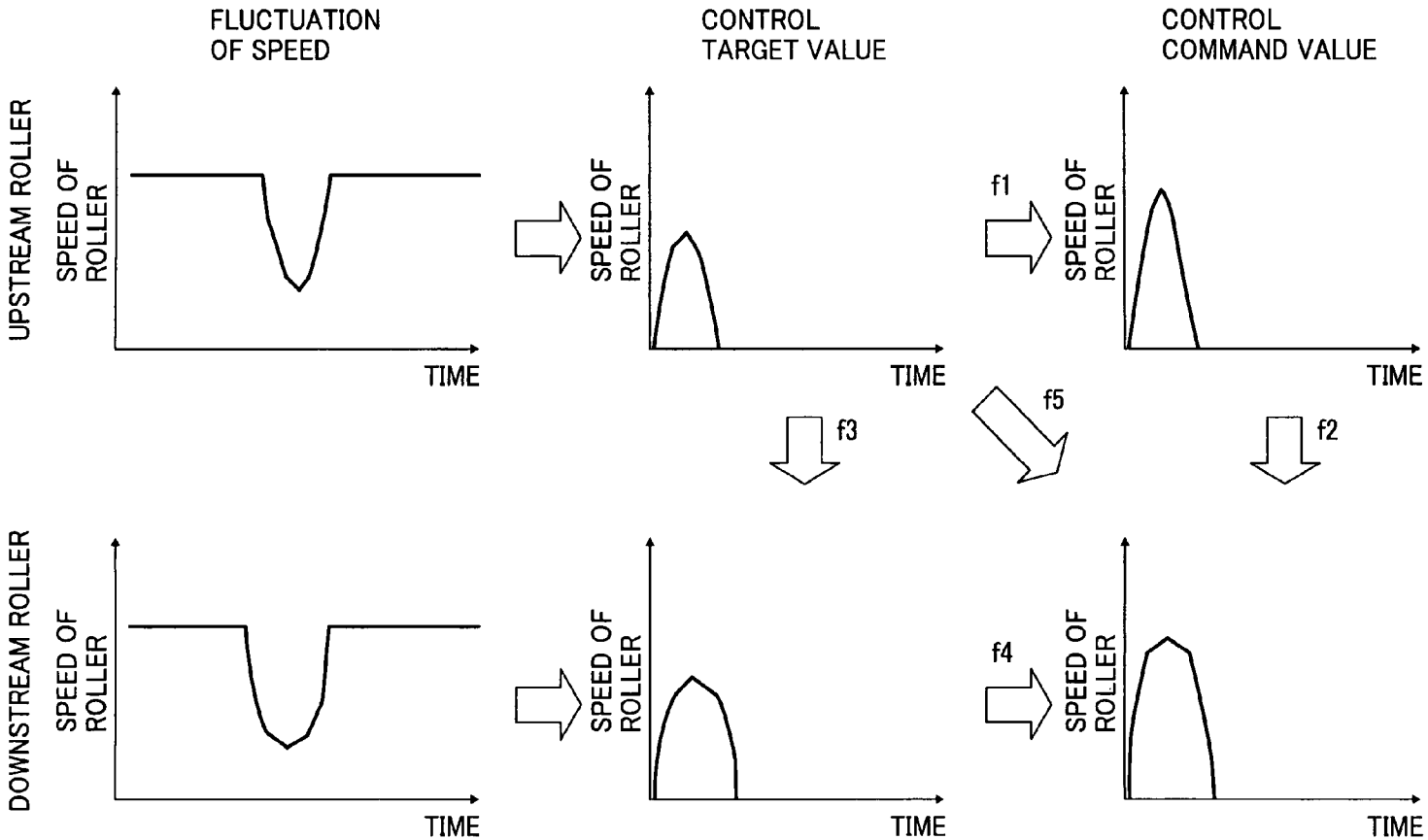
FIG. 7 is a diagram for explaining a procedure of converting the control target value to a control command value.

FIG. 7 is a diagram for explaining a procedure of converting a control target value obtained from fluctuation of speed of the upstream rollers 1 to a control command value of the downstream rollers 2.

First, a control target value obtained from the upstream rollers 1 is converted to a control command value of the upstream drive roller la by a function f1. The control command value of the upstream drive roller 1*a* is then converted to a control command value of the downstream drive roller 2*a* by a function f2. Alternatively, functions f3 and f4 can be used to perform conversion. Functions f1 to f4 are calculated beforehand by experiments or numerical analysis.

When the upstream rollers 1 and the downstream rollers 2 have the same configuration, the control target value of the downstream rollers 2 can be obtained only by using the function f1.

As described above, the downstream drive roller 2*a* is controlled by using a control command value obtained by the feedforward controller 22.

A control command value (lower right in FIG. 7) is calculated for the downstream rollers 2 based on fluctuation of speed of the upstream rollers 1 (upper left in FIG. 7). To calculate the control command value on the real time basis, conversion functions are determined beforehand by experiments or the like, and these functions are used. There are three conversion routes of f1→f2, f3→f4, and f5, and neither of these is particularly superior.

The Y axis in the graph indicating the control command value in FIG. 7 indicates any one of the drive voltage, drive current, or drive frequency to be provided to the driving source. In the DC motor or the direct drive motor, when voltage control is performed, the Y axis indicates the drive voltage, and when current control is performed, the Y axis indicates the drive current. In the pulse motor or the ultrasonic motor, the Y axis indicates the drive frequency.

The function f1 is an inverse function of a transfer function from an input of the driving source to an output of the pair of rollers in the upstream rollers 1. The function f4 is an inverse function of a transfer function from an input of the driving source to an output of the pair of rollers in the downstream rollers 2. These functions f1 and f4 can be calculated based on a physical constant of a component of the apparatus. Further, when the system configuration is complicated, these functions can be calculated by using a system identification method.

The function f2 converts the control command value in the upstream rollers 1 to the control command value in the downstream rollers 2. The function f3 converts the control target value in the upstream rollers 1 to the control target value in the downstream rollers 2. These functions can be identified based on the control command value or the control target value in the upstream rollers 1 and the downstream rollers 2.

The function f5 converts the control target value in the upstream rollers 1 to the control command value in the downstream rollers 2. The function f5 can be identified based on the control target value in the upstream rollers 1 and the control command value for the downstream rollers 2.

When the upstream rollers 1 and the downstream rollers 2 have the identical configuration, fluctuation of speed generated in the respective pairs of rollers is the same, and therefore, f1=f4=f5, f2=f3=1. If the upstream rollers 1 and the downstream rollers 2 have a similar configuration, the functions f1 and f4, and f5 become simpler conversion functions, and as their configuration becomes different (profile of fluctuation of speed is different), f1, f4, and f5 become more complicated conversion functions.

While it has been described that there are three conversion routes of f1→f2, f3→f4, and f5, and neither of these is particularly superior, there are merits and demerits of each conversion route, and they are described below.

In the case of converting the function f5, only one operation is required, and response is the best. However, because the operation itself becomes slightly complicated, a central processing unit (CPU) requires performance to some extent. In the case of conversions f1→f2 and f3→f4, the number of operations is two, and though the response is slightly inferior, one operation becomes simple. Therefore, an inexpensive CPU can be used. The conversions f1→f2 and f3→f4 are substantially equal in view of the performance. However, at the time of calculating the functions f1 and f4, calculation becomes easier and errors are reduced, as the configuration of the upstream and downstream rollers becomes simpler (e.g., not including a belt). Also in the functions f2 and f3, easiness of identification and errors vary according to the speed as the control target value and an intensity waveform of the control command value. Accordingly, the conversions f1→f2 and f3→f4 can be selected according to the easiness of calculation and the magnitude of errors.

Figure 8:
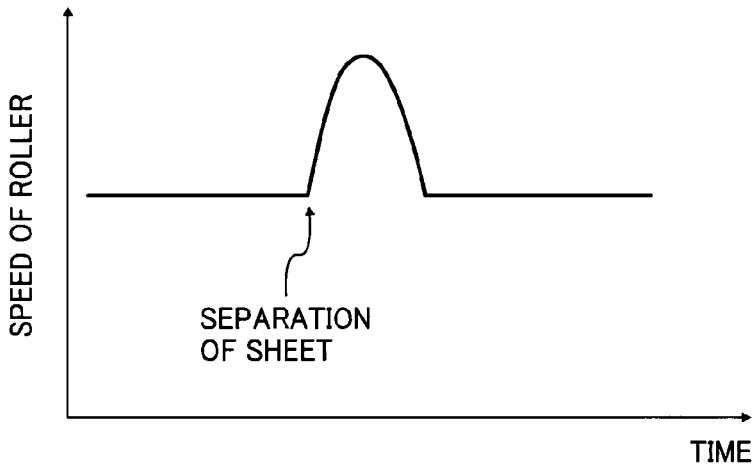
FIG. 8 is a graph of fluctuation of speed when a sheet is separated from a pair of rollers.

The speed of the pair of rollers fluctuates not only when a thick sheet enters into the pair but also when the thick sheet is separated from the pair. FIG. 8 is a graph of fluctuation of speed when a sheet is separated from the pair of rollers. As shown in FIG. 8, when a sheet is separated from the rollers, speed of the rollers fluctuates, i.e., the speed increases, contrary to the case where a sheet enters into the rollers. At this time, a threshold Vth' is set, and the speed information is obtained only in a period during which fluctuation of speed exceeds Vth', and then fluctuation of speed can be reduced in the same manner as when a sheet enters into the rollers. The delay time of the timing controller 23 is from detection of the sheet P by the sheet detector 12 until the sheet P is separated from the pressed part between the drive roller 2*a* and the driven roller 2*b*. When the length in the sheet conveying direction of the sheet to be used is predetermined, the separation time can be calculated based on the length of the sheet. When the sheets having various lengths are used, the sheet detector 11 in the upstream rollers 1 is used as the length detector to detect the sheet length, the separation time is calculated based on the length determined by the calculating unit 14 and the sheet-conveying speed, and control is performed by using the calculated time as the delay time of the timing controller 23. The sheet detector (length detector) 11 can be of any type, so long as a sheet can be detected, such as an optical sensor or a magnetic sensor. When the processing speed of the calculating unit 14 is sufficiently high, the sheet detector 12 can be used as the length detector.

When the control target value is calculated, a plurality of pieces of speed information is stored in the storage unit 13, to calculate the control target value by averaging these pieces of speed information, thereby enabling to calculate the control target value with higher accuracy. Even if the same type of sheet is used, the same fluctuation of speed does not occur all the time, and fluctuation of speed is slightly different. Therefore, by calculating the control target value based on the pieces of speed information, more accurate control target value can be calculated, thereby enabling to obtain more stable effect. For example, a changeover switch or a mode selection unit can be provided so that a normal mode in which the control target value is calculated based on one piece of speed information, and a highly accurate mode in which the highly accurate control target value is calculated based on pieces of speed information can be selected. In the highly accurate mode, a more accurate control target value can be calculated to obtain more stable effect. On the other hand, in the normal mode, calculation of the control target value becomes simple to reduce a load on the CPU, and less memory capacity is required.

When it is known beforehand that the same sheets are continuously used, it is preferable to add a function for setting to use the control target value calculated for the first sheet repetitively. When this function is selected, repetition of the same process can be omitted, thereby enabling to reduce wasteful power consumption. For example, by providing the changeover switch or the mode selection unit, the target value can be calculated every time or only for the first time, according to the selected mode.

Appropriate control can be performed regardless of the sheet thickness, sheet type, and environmental conditions, by generating the control target value based on fluctuation of speed of the upstream rollers 1, thereby enabling to reduce fluctuation of speed of the downstream rollers 2. Thus, according to the first embodiment, fluctuation of speed of the pair of rollers occurring when a thick sheet enters into the pair or leaves the pair can be reduced, and the speed of the pair to be controlled can be controlled constant at all times.

Because a thickness sensor or the like that detects the thickness of the sheet is not required, cost increase can be suppressed. Further, fluctuation of speed of a member that conveys the sheet can be effectively prevented regardless of the sheet type and environmental conditions.

Figure 9:
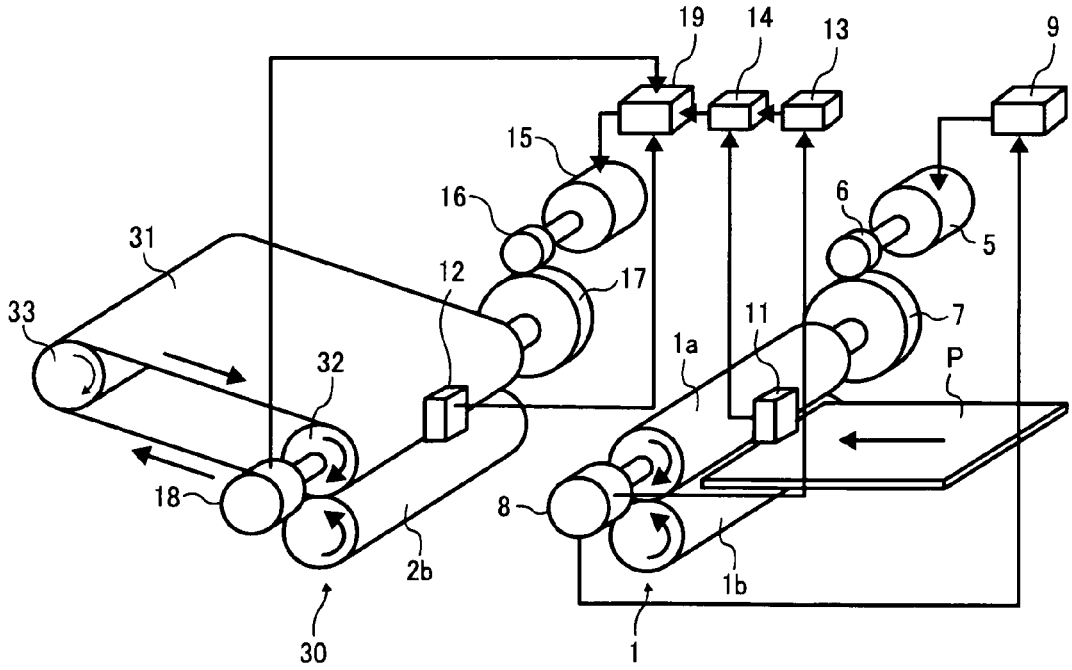
FIG. 9 is a schematic diagram of a sheet conveying device according to a second embodiment of the present invention.

FIG. 9 is a schematic diagram of a sheet conveying device according to a second embodiment of the present invention. In the sheet conveying device of the second embodiment, a downstream sheet conveying unit includes an endless belt. That is, as shown in FIG. 9, a downstream sheet conveying unit 30 uses an endless belt 31 on a drive side. The endless belt 31 is stretched over a drive roller 32 and a support roller 33. The driven roller 2*b* is pressed against the drive roller 32 via the endless belt 31. The sheet conveying device of the second embodiment is otherwise basically the same as that of the first embodiment shown in FIG. 1. The endless belt can be stretched over three or more roller members.

An upstream sheet conveying unit can include an endless belt, while a downstream sheet conveying unit can include no endless belt. Besides, both the upstream and downstream sheet conveying units can include an endless belt. In addition, there can be three or more pairs of sheet conveying units, and any pair or pairs of sheet conveying units as well as all of them can include an endless belt. An endless belt can be located on the driven side (driven-roller side) as a sheet conveying unit.

Also in the sheet conveying device having such a configuration, fluctuation of speed of the pair of rollers occurring when the thick sheet enters into the pair (including the one using the endless belt) or leaves the pair can be reduced by the same control as in the sheet conveying device according to the first embodiment, and the speed of the pair to be controlled can be controlled constant at all times.

Because the thickness sensor or the like that detects the thickness of the sheet is not required, cost increase can be suppressed. Further, fluctuation of speed of the member that conveys the sheet can be effectively prevented regardless of the sheet type and environmental conditions.

When the sheet conveying unit includes the endless belt, the speed of the endless belt can be measured as the speed measuring unit of the pair of rollers. As means for detecting the belt speed, there is a method of measuring the surface speed of the belt by a laser Doppler velocimeter, or a method of measuring the speed by detecting a scale applied on the belt by an optical sensor.

The sheet conveying device of the above embodiments is effectively applied to any types of apparatuses required to convey a sheet, such as an electrophotographic image forming apparatus in which the sheet conveying unit is used in an intermediate transfer unit and a fuser. Explained below is such a tandem image forming apparatus of an intermediate transfer system.

Figure 10:
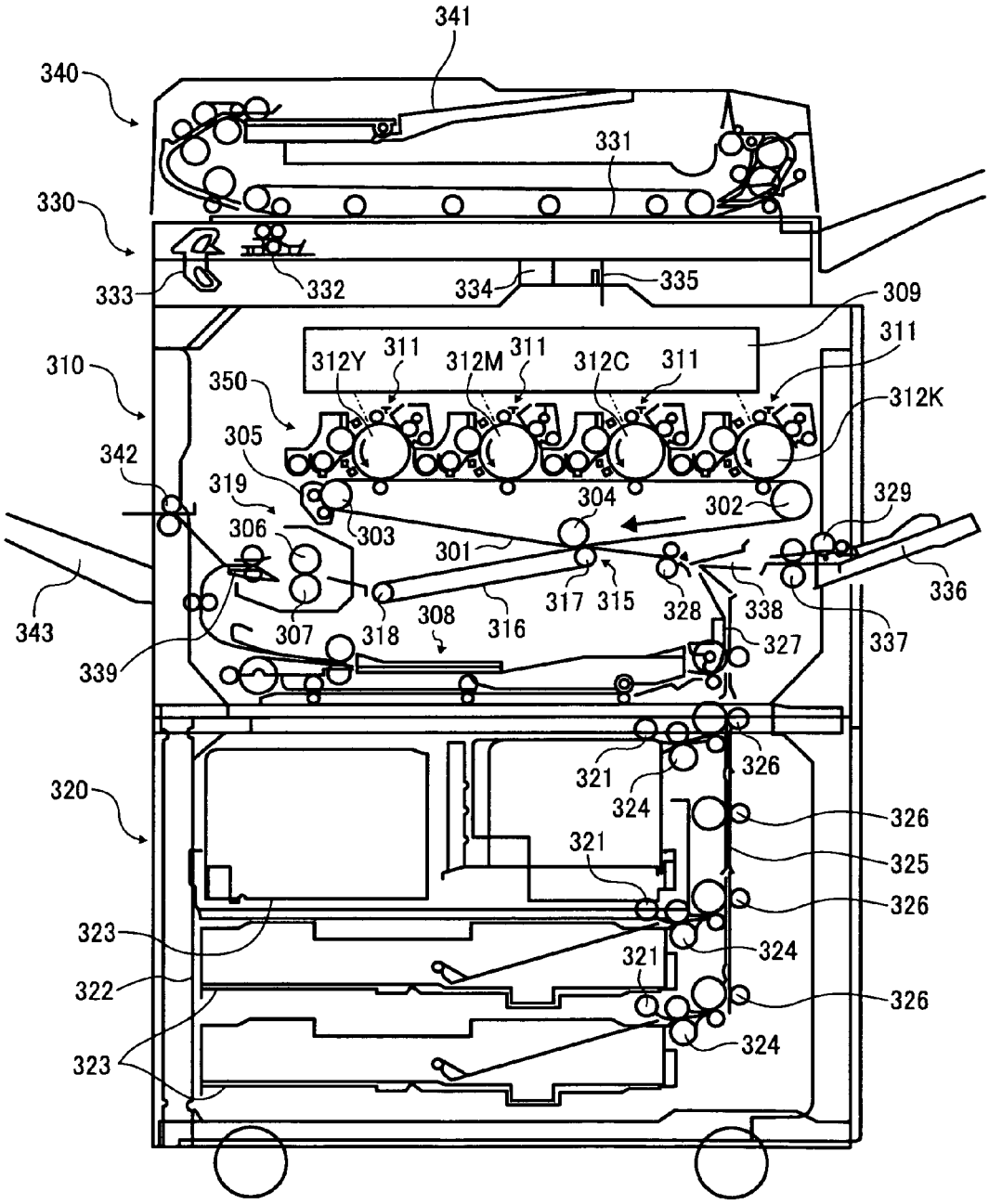
FIGS. 10 to 12 are schematic diagrams of examples of an image forming apparatus according to the embodiments.

FIG. 10 is schematic diagram of a full-color electrophotographic copier of a tandem intermediate transfer system including a scanner as an example of an image forming apparatus according to the embodiments. The copier includes an apparatus body 310 mounted on a feed table 320, a scanner 330 arranged on the apparatus body 310, and an automatic document feeder (ADF) 340 on the scanner 330.

An endless intermediate transfer belt 301 is provided in the center of the apparatus body 310 as an intermediate transfer member. The intermediate transfer belt 301 is spanned over three support rollers 302, 303, and 304 so that it can rotate clockwise in FIG. 10. Hereinafter, when a rotation movement of the belt is partially seen, it is referred to simply as a movement. Among the three support rollers, at the left of the second support roller 303, an intermediate-transfer-belt cleaning device 305 is provided for removing a residual toner remaining on the intermediate transfer belt 301 after image transfer.

Further, on the intermediate transfer belt 301 stretched over between the first support roller 302 and the second support roller 303 among the three support rollers, four imaging units 311 for yellow (Y), magenta (M), cyan (C), and black (B) are arranged horizontally along the movement direction of the belt to form a tandem image forming unit 350. In this example, the third support roller 304 is set as the drive roller. An exposure device 309 is provided on the tandem image forming unit 350.

While the image forming apparatus using an intermediate transfer belt is described here, the image forming apparatus can use an intermediate transfer drum. In this case, the support rollers 302, 303, and 304 are not required, and the image forming unit is arranged not horizontally but around the intermediate transfer drum. That is, the intermediate transfer unit can be an intermediate transfer belt as well as an intermediate transfer drum.

On the other hand, a secondary transfer unit 315 is provided on the opposite side of the tandem image forming unit 350, put the intermediate transfer belt 301 therebetween. In the illustrated example, the secondary transfer unit 315 is formed by spanning a secondary transfer belt 316, which is an endless belt, between two belt support rollers 317 and 318. The secondary transfer unit 315 is pressed against the third support roller 304 via the intermediate transfer belt 301, to transfer an image on the intermediate transfer belt 301 onto the sheet. A fuser 319 that fixes an unfixed image transferred on the sheet is provided at the side of the secondary transfer unit 315. The secondary transfer unit 315 also has a sheet conveying function for conveying the sheet after image transfer to the fuser 319. A transfer roller or a non-contact type charger can be arranged as the secondary transfer unit, and in this case, a conveying unit that conveys the sheet from the secondary transfer unit to the fuser needs to be provided separately.

The fuser 319 is formed by pressing a pressure roller 307 against a fuser roller 306. The fuser roller 306 has a heat generating mechanism therein, and is heated up to a temperature required for fixing an image. An unfixed image on a sheet is applied with heat and pressure and fixed on the sheet. The fuser can be a fixing belt or a fixing roller.

In the above example, a sheet reversing unit 308 that reverses the sheet to record images on the opposite sides of the sheet is provided below the secondary transfer unit 315 and the fuser 319, in parallel with the tandem image forming unit 350.

When a copy is made by using the electrophotographic device, an original document is set on an original table 341 in the ADF 340. Alternatively, the ADF 340 is opened to set the document on a exposure glass 331 of the scanner 330 and closed to hold the document. The term "document" as used herein refers to any medium including text, an image, a photograph, a chart, and a table.

When a start switch (not shown) is pressed, the document is conveyed onto the exposure glass 331, in a case that the document is set in the ADF 340. On the other hand, in a case that the document is set on the exposure glass 331, the scanner 330 is immediately driven. A first carrier 332 and a second carrier 333 are driven next. While beams are irradiated from a light source by the first carrier 332, reflected light from the document surface is further reflected toward the second carrier 333, and reflected by a mirror in the second carrier 333 toward a read sensor 335 through an imaging lens 334, thereby reading the document content.

In parallel with document read, the support roller 304 is rotated by a drive motor (not shown), to rotate other two support rollers, thereby rotating the intermediate transfer belt 301. Simultaneously, in the individual imaging unit 311, a photosensitive drum 312 is rotated to expose and develop an image respectively by using color information of yellow, magenta, cyan, and black, thereby forming a single color toner image. With the movement of the intermediate transfer belt 301, these single color toner images are sequentially transferred thereto to form a synthesized color image on the intermediate transfer belt 301.

On the other hand, concurrently with image formation, one of feed rollers 321 of the feed table 320 is selected and driven to feed a sheet from one of a plurality of feed cassettes 323 provided in a sheet bank 322. Sheet are separated by a pair of separation rollers 324 and conveyed one by one by a conveyor roller 326 to a feed path 325, on which the sheet abuts against a registration roller 328 and stops. Alternatively, a bypass feed roller 329 is rotated to feed sheets on a bypass tray 336. The sheets are separated by a pair of separation rollers 337 and conveyed one by one to a bypass feed path 338, on which each sheet abuts against the registration roller 328 and stops.

The registration roller 328 is rotated, with the timing matched with the synthesized color image on the intermediate transfer belt 301, to feed the sheet to between the intermediate transfer belt 301 and the secondary transfer unit 315, and the image is transferred by the secondary transfer unit 315 to record a color image on the sheet.

The sheet after image transfer is conveyed by the belt 316 and fed to the fuser 319, and applied with heat and pressure in the fuser 319 to fix the transferred image thereon. The sheet is then switched by a switching claw 339, ejected by an ejection roller 342, and stacked on a eject tray 343. Alternatively, the sheet is switched by the switching claw 339 to be put into the sheet reversing unit 308, where the sheet is reversed and guided again to the transfer position, so that an image is recorded also on the other side of the sheet. The sheet is then ejected onto the eject tray 343 by the ejection roller 342.

On the other hand, the intermediate transfer belt 301 after image transfer is cleaned by the intermediate-transfer-belt cleaning device 305 to remove the residual toner remaining on the intermediate transfer belt 301 after image transfer, to prepare for next image formation by the tandem image forming unit 350. The registration roller 328 is generally grounded and used; however, a bias can be applied thereto to remove dust on the sheet.

A black monochrome copy can be made by using the electrophotographic device. In this case, the intermediate transfer belt 301 is separated from the photosensitive drums 312Y, 312C, and 312M by a unit (not shown). Rotation of these photosensitive drums are temporarily suspended, and only the black photosensitive drum 312K is brought into contact with the intermediate transfer belt 301 to perform image formation and transfer.

Figure 11:
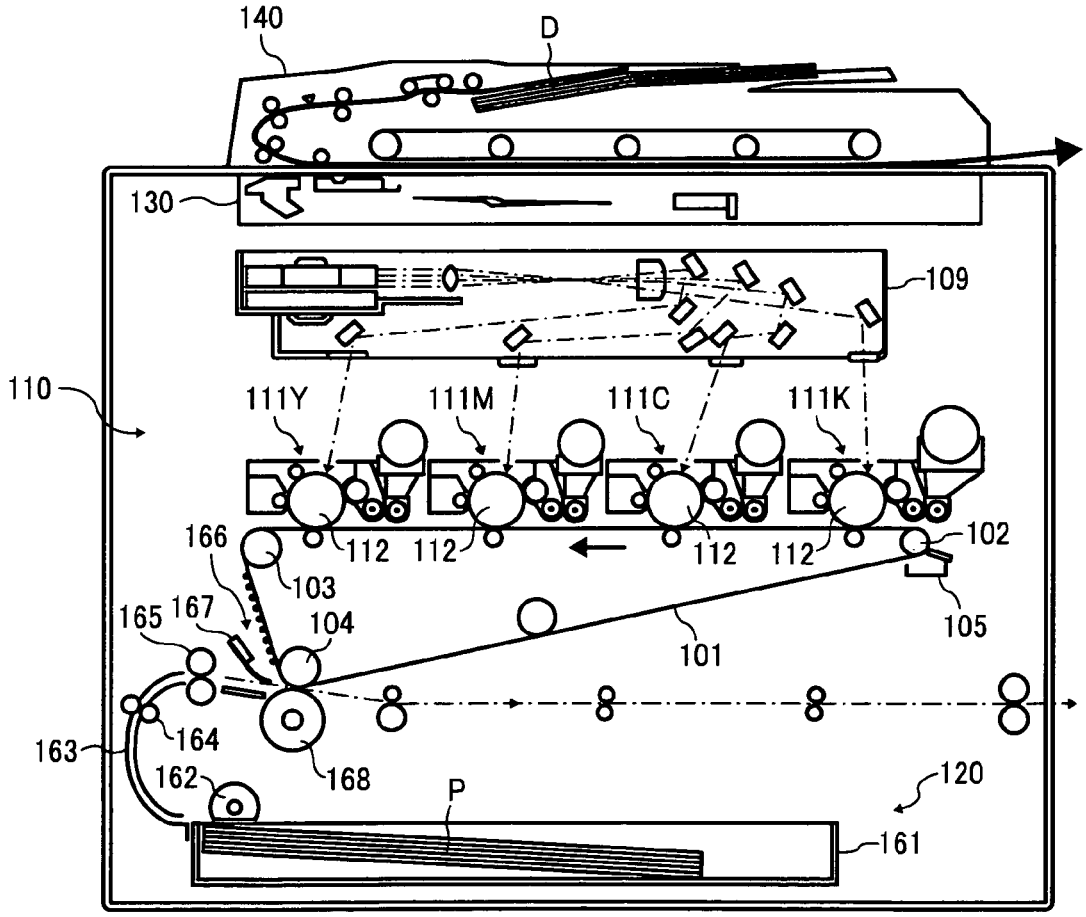
Figure 12:
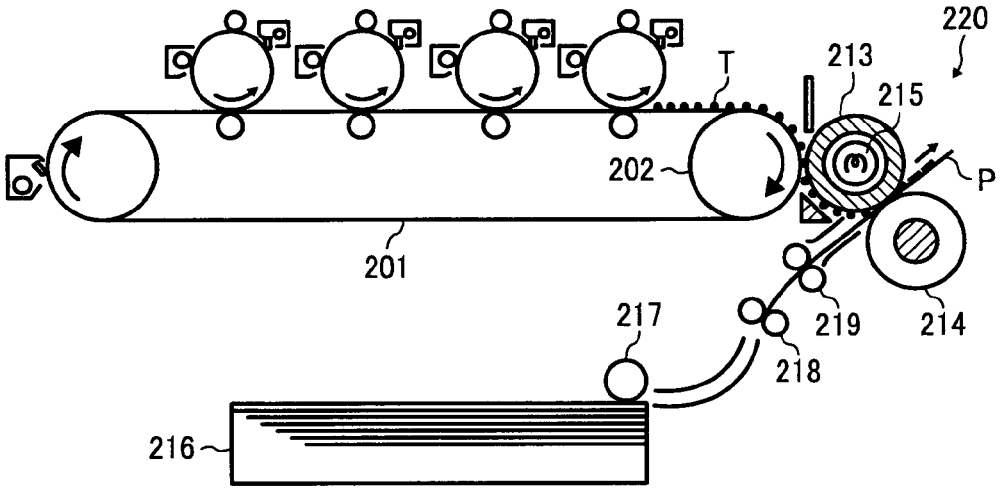

FIGS. 11 and 12 are schematic diagrams of other examples of a tandem image forming apparatus of the intermediate transfer system. The image forming apparatus of FIGS. 11 and 12 is basically similar to that of FIG. 10 except for a transfer-fixing unit for simultaneously transferring and fixing an image onto a sheet at a time, and the electrophotographic process is well-known. Therefore, explanation thereof is not detailed here, and different part, i.e., the transfer-fixing unit, is mainly explained.

The image forming apparatus shown in FIG. 11 is, for example, a copier as the image forming apparatus of FIG. 10. The image forming apparatus includes an imaging unit 110 arranged in the center, a feeder 120 arranged at the bottom, a scanner 130 arranged at the upper part with an ADF 140 provided thereon.

The image forming apparatus of FIG. 11 includes a transfer and fixing roller 104, which is one of the support rollers over which an intermediate transfer belt 101 is stretched. A pressure roller 168 is provided so that it is pressed against the transfer and fixing roller 104, putting the intermediate transfer belt 101 therebetween. A sheet heating unit 167 is arranged on the immediately upstream of the pressure roller 168 (in the sheet conveying direction). In this example, the sheet heating unit 167, the transfer and fixing roller 104, and the pressure roller 168 constitute a transfer-fixing unit 166. The sheet heating unit is not limited to the plate-like unit as shown in FIG. 11, and a roller can be used. The pressurizing unit can be a pressure pad or a pressure belt, and it is not limited to rollers.

A feed cassette 161 is arranged in the feeder 120 provided at the bottom of the apparatus body, and a feed unit 162 that feeds the sheet from the feed cassette 161 is provided. The sheet fed from the feed cassette 161 is conveyed by a pair of conveyor rollers 164 arranged on a sheet-conveying path 163, and is fed to the transfer-fixing unit 166 by a pair of registration rollers 165.

In the transfer-fixing unit 166, the surface of the sheet is heated to a temperature sufficient for melting the toner by the sheet heating unit 167. The heated sheet is inserted into a nip formed by the transfer and fixing roller 104, the pressure roller 168, and the intermediate transfer belt 101. At this time, the toner image on the intermediate transfer belt is melted by the heat of the sheet and is simultaneously pressurized by the nip, thereby transferring onto and fixed on the sheet.

FIG. 12 is a schematic diagram of relevant part of another example of an image forming apparatus including a transfer-fixing unit having a different configuration from that shown in FIG. 11.

As shown in FIG. 12, a roller-shaped second intermediate transfer member 213 is arranged opposite to a support roller 202 of an intermediate transfer belt 201, so that the intermediate transfer belt 201 is interposed therebetween and pressed. The second intermediate transfer member 213 includes a heater 215 therein, and functions as a heating unit. A pressure roller 214 is arranged so that it is pressed against the second intermediate transfer member 213. In this example, a transfer-fixing unit 220 includes the second intermediate transfer member 213 as the heating unit and the pressure roller 214.

A stack of sheets in a feed tray 216 is fed by a feed unit 217. The sheet fed from the feed tray 216 is conveyed by a pair of conveyor rollers 218 arranged on a sheet-conveying path and fed to the transfer-fixing unit 220 by a pair of registration rollers 219.

The toner image conveyed on the intermediate transfer belt 201 is transferred from the intermediate transfer belt 201 to the second intermediate transfer member 213. The secondarily transferred toner image is melted on the second intermediate transfer member 213 heated by the heater 215, pressed at the nip formed by the second intermediate transfer member 213 and the pressure roller 214, and transferred onto and fixed on the sheet.

The second intermediate transfer member is not limited to a roller shape in the illustrated example, and can be a belt shape. Also for the heating unit, an arbitrary heating unit can be used, such as a halogen heater, a ceramic heater, or an induction heater can be used, and the format and method are not limited. Further, the format and method of the pressurizing unit are not limited to the illustrated example.

Explained below is a case that the above embodiments are applied to a secondary transfer unit of the copier shown in FIG. 10.

Figure 13:
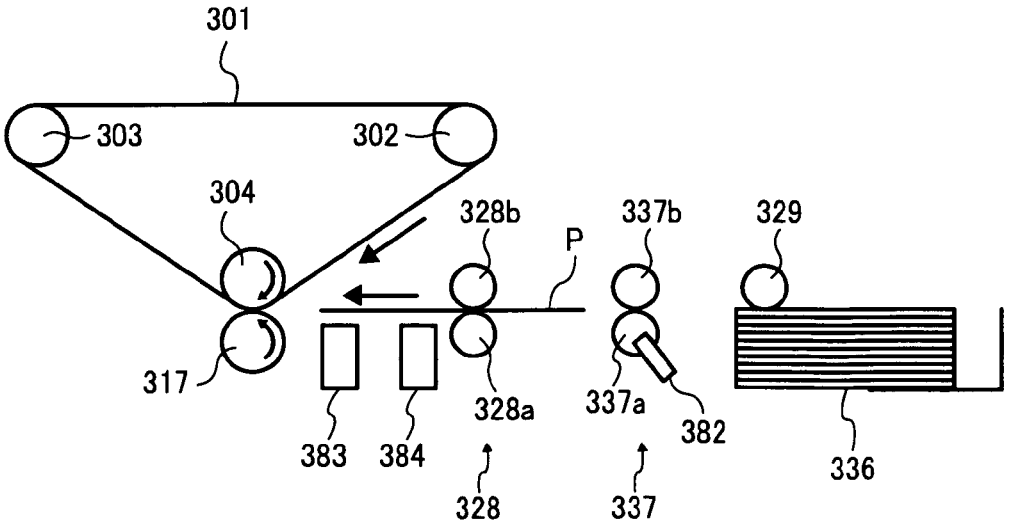
FIG. 13 is a schematic diagram of a secondary transfer unit in the image forming apparatus shown in FIG. 10.

FIG. 13 is a schematic diagram of a configuration from the bypass tray 336 to a secondary transfer unit of the copier. The separation rollers 337 pick a sheet from a stack of sheets on the bypass tray 336. The separation rollers 337, the registration roller 328, a third support roller 304 as the secondary transfer unit, and a belt support roller 317 are driven by the same drive system or control system as previously described for the sheet conveying device according to the first and second embodiments.

As shown in FIG. 13, a speed measuring unit 382 is provided in a drive roller 337*a* of the separation roller 337 to obtain speed information of the separation roller 337. The roller whose speed is to be measured can be an opposite separation roller (driven roller) 337*b*. Alternatively, the speed information of the driving source for driving the separation roller 337 can be measured. As the measurement method, any methods explained in the first embodiment can be used.

A drive roller 328*a* of the registration roller 328, an opposite registration roller 328*b*, which is the driven roller, or the bypass feed roller 329 can be the roller whose speed is to be measured. For these rollers, however, to convey the sheet from a stopped state, starting time of the rollers and the driving source or a drive current value at the time of startup needs to be measured at the time of calculating the control target value. Therefore, it is desired to use the separation roller 337, into which the sheet enters during rotation thereof, as the roller whose speed is to be measured. Further, when there is a roller in the same state as the separation roller between the feed roller and the registration roller, the rotation speed of the roller can be measured.

An entrance detector for predicting that the sheet P enters into the secondary transfer unit formed of the third support roller 304 (drive roller) and the belt support roller 317 (driven roller) predicts the entering of the sheet based on a detection signal from a sheet detection sensor 383 arranged between the registration roller 328 and the secondary transfer unit. When the sheet detection sensor 383 is not used, an operation signal of the sheet conveying unit, such as an operation start signal of the registration roller 328 or an ON signal of a registration clutch is used for detecting the sheet or speed fluctuation information of the separation roller 337 can be used to detect the sheet.

When control is performed not only when the sheet enters into but also leaves the secondary transfer unit, a length detection sensor 384 that detect the sheet length needs to be installed. The type of the sensor to be used is the same as that explained in the first embodiment. As explained in the first embodiment, when the process in the calculating unit is performed in a sufficiently early stage, the sheet detection sensor 383 can also serve as the length detection sensor 384. The control is performed basically in the same manner as in the first embodiment, and the same explanation is not repeated.

Explained below is a case that the above embodiments are applied to the transfer-fixing unit of the image forming apparatus shown in FIGS. 11 and 12.

Figure 14:
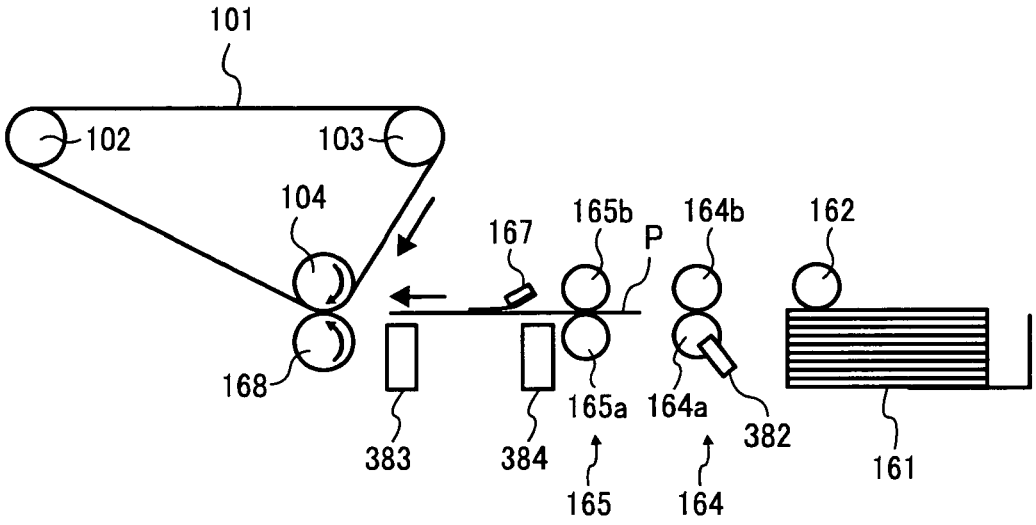
FIG. 14 is a schematic diagram of a transfer-fixing unit in the image forming apparatus shown in FIG. 11.
Figure 15:
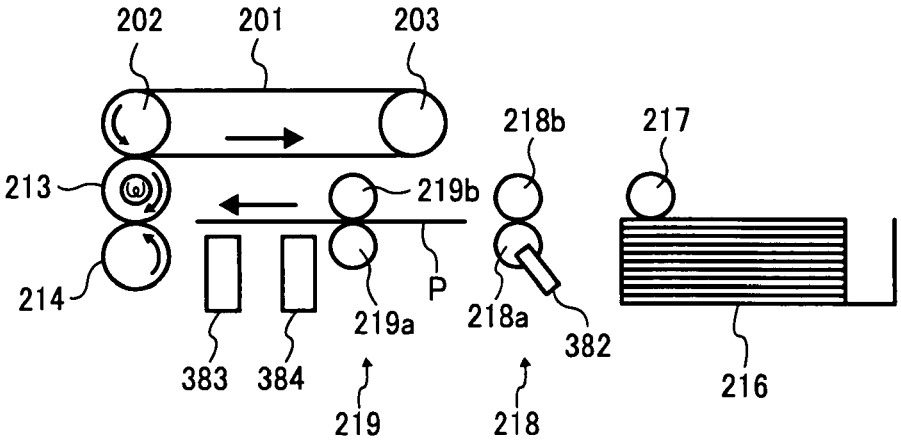
FIG. 15 is a schematic diagram of a transfer-fixing unit in the image forming apparatus shown in FIG. 12.

FIG. 14 is a schematic diagram of a configuration covering from the feed cassette 161 to the transfer-fixing unit. FIG. 15 is a schematic diagram of a configuration covering from the feed tray 216 to the transfer-fixing unit. The configuration for conveying a sheet from the sheet tray to the transfer-fixing unit is basically the same as previously described for the secondary transfer unit in FIG. 13, and the same explanation is not repeated. As shown in FIGS. 14 and 15, the above embodiments can be applied to the transfer-fixing unit as in the case of the secondary transfer unit.

Explained below is a case that the above embodiments are applied to a fuser of the copier shown in FIG. 10.

Figure 16:
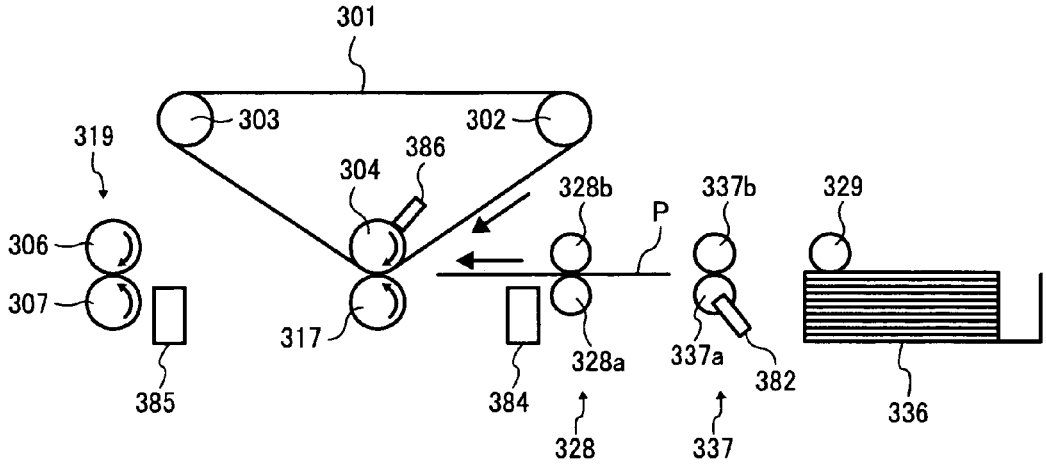
FIG. 16 is a schematic diagram of a fuser in the image forming apparatus shown in FIG. 10.

FIG. 16 is a schematic diagram of a configuration covering from the bypass tray 336 to the fuser 319 shown in FIG. 10. In this case, it is required to measure fluctuation of speed of rollers at upstream of the fuser. When fluctuation of speed is measured from a roller on the sheet-conveying path, the same procedure is performed as in the case of the secondary transfer unit, and the same explanation is not repeated.

The speed of the third support roller 304 (drive roller) of the secondary transfer unit is measured by a speed detector 386 to obtain a control target value. Other than the third support roller 304, the roller whose speed is to be measured can be any roller of the belt support roller 317 (driven roller), the first support roller 302, the second support roller 303, and the intermediate transfer belt 301. The measuring unit used here is the same as the unit of the sheet conveying device according to the first and second embodiments.

The entrance detector for predicting the entering of the sheet P into the fuser including the fuser roller 306 and the pressure roller 307 predicts the entering of the sheet based on a detection signal from a sheet detection sensor 385 installed between the fuser and the secondary transfer unit. When the sheet detection sensor 385 is not used, the sheet can be detected by using an operation signal of the secondary transfer unit or the speed information of the secondary transfer unit. Further, the operation signal of the sheet conveying unit, such as the operation start signal of the registration roller 328 or the ON signal of the registration clutch is used for detecting the sheet or speed fluctuation information of the separation roller 337 can be used to detect the sheet.

Further, when control is performed as well when the sheet is separated from the secondary transfer unit, a sheet length detector is required. The length detection sensor 384 can be used as the sheet length detector. As explained in the first embodiment, when the process in the calculating unit is performed in a sufficiently early stage, the sheet detection sensor 385 can also serve as the length detection sensor 384. However, in the fuser, the necessity for performing the control at the time of sheet separation is low. The control operation is performed basically in the same manner as in the first embodiment, and the same explanation is not repeated.

Explained below is a case that the above embodiments are applied to both the secondary transfer unit and fuser of the copier shown in FIG. 10.

Figure 17:
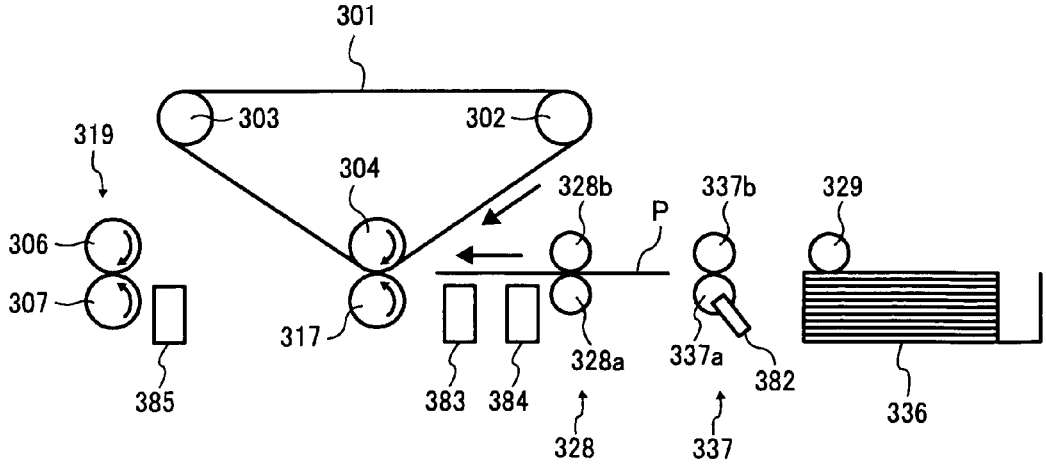
FIG. 17 is a schematic diagram of the secondary transfer unit and the fuser in the image forming apparatus shown in FIG. 10.

In this case, both the secondary transfer unit and fuser are formed as shown in FIG. 17, and the speed information is obtained from the roller in the sheet conveying unit. The control target value calculated from the obtained speed information is used for controlling both the secondary transfer unit and fuser.

When the distance between the secondary transfer unit and the fuser is close to each other and the processing speed of the calculating unit is sufficiently high, the function of the sheet detection sensor 383, the sheet detection sensor 385, and the length detection sensor 384 can be performed only by the sheet detection sensor 383. Other configurations in this example are the same as the configuration shown in FIG. 12.

Generally, the bypass tray is used for a sheet with a certain level of thickness, as explained in FIGS. 13 to 17, the speed information is obtained by the separation roller 337 in the manual feed unit, which enables effective control for the influence of fluctuation of speed at the time of using a thick sheet.

In the copier in this example, as explained in the first and second embodiments, the normal mode the control target value is calculated based on one piece of speed information, and the highly accurate mode in which the highly accurate control target value is calculated based on pieces of speed information can be selectively provided. Further, when it is known beforehand that the same sheets are continuously used, the changeover switch or the mode selection unit is provided so that the control target value calculated for the first sheet can be repetitively used, and it can be changed over whether to calculate the target value every time or only for the first time, according to the selected mode. The changeover switch or the mode selection unit can be provided in the calculating unit of the copier.

As described above, according to the embodiments, fluctuation of speed of a pair of rollers can be controlled when a thick sheet enters into or leaves the secondary transfer unit, the fuser, or the transfer-fixing unit. Because fluctuation of speed of the rollers in the secondary transfer unit is suppressed, fluctuation of speed of the intermediate transfer belt 301 can be prevented, and image distortion in the primary transfer unit, for example, an out of color registration of the respective color images can be efficiently prevented. As a result, a high-quality full-color image can be obtained. Further, because fluctuation of speed of the rollers in the fuser is suppressed, image distortion such as blur in an unfixed toner image in the secondary transfer unit on the upstream side can be prevented. Further, because fluctuation of speed of the rollers in the transfer-fixing unit is suppressed, fluctuation of speed of the intermediate transfer member can be prevented, and image distortion occurring in the primary transfer unit or the secondary transfer unit can be also prevented, thereby enabling to obtain the high-quality full-color image.

While, in the above embodiments, the number of sheet conveying units of the sheet conveying device is explained as two pairs, by way of example and without limitation, the sheet conveying device can include three or more pairs of sheet conveying units. The sheet conveying unit can include an endless belt, and the endless belt can be arranged either on the drive side or the driven side. The speed measuring unit that obtains the speed information of the sheet conveying unit can adopt an appropriate method or configuration. A drive system that drives the sheet conveying unit has arbitrary configuration. The calculation method of the control target value and the procedure of converting the obtained control target value to the control command value are described by way of example only.

In addition, the image carrier (photosensitive element) is not limited to a drum shape, and a belt-shaped image carrier can also be used. The configuration of the imaging unit need not necessarily be as described above, and arrangement sequence of the imaging units of respective colors in the tandem system can be changed. Further, the configuration is not limited to the tandem system, and a configuration in which a plurality of developing devices is arranged around one photosensitive element or a configuration of using a revolver-type developing device can be also used. The image forming apparatus of the embodiments can be a full-color machine using three color toners, a multi-color machine using two color toners, or a monochrome machine. When the intermediate transfer member is used, not only an indirect transfer method but also a direct transfer method can be used. The image forming apparatus is explained above as a copier; however, it can be, for example, a printer, a facsimile machine, a scanner or a multifunction product (MFP) that combines any or all of functions of these.

While, in the above embodiments, the sheet conveying device is applied to an image forming apparatus, it can also be applicable to any devices that convey a sheet-type medium, for example, a reading device such as a scanner, an ADF, or the like. Such a scanner or an ADF can be incorporated in an image forming apparatus.

As set forth hereinabove, according to an embodiment of the present invention, fluctuation in moving speed of the sheet conveying unit can be suppressed, and the moving speed can be maintained constant. Thus, high-quality image output can be achieved.

Moreover, a control target value can be obtained with high accuracy every time a sheet passes. This reduces memory capacity required for storing the control target value as well as enabling appropriate control for any type of recording medium regardless of the thickness and width thereof and use environment.

Furthermore, the same process is not repeated to simplify the control operation, which reduces wasteful power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a plurality of conveying units each including a drive roller and a driven roller to convey a recording medium while holding the recording medium between the drive roller and the driven roller, the conveying units including a first conveying unit, that conveys the recording medium to an image transfer unit, and a second conveying unit, that transfer an image to the recording medium, the second conveying unit being located more than a sheet length of the recording medium downstream of the first conveying unit in a conveying direction in which the recording medium is conveyed, speed of the drive roller of the second conveying unit being controllable;

a first measuring unit attached to a shaft of the drive roller of the first conveying unit that obtains speed information of the first conveying unit;

a second measuring unit attached to a shaft of the drive roller of the second conveying unit that obtains speed information of the second conveying unit;

a storage unit that stores therein the speed information obtained from the first measuring unit when the recording medium enters the first conveying unit only when the measured speed falls below a threshold speed and the storage unit stores the speed information obtained from first measuring unit when the recording medium exits the first conveying unit only when the measured speed increases above the threshold speed;

a calculating unit that calculates a target value based on the speed information stored in the storage unit, and a controller that receives the speed information from the second measuring unit, wherein the speed of the drive roller of the second conveying unit is controlled by the controller based on the target value and the input speed information from the second measuring unit.

2. The sheet conveying device according to claim 1, further comprising an estimating unit that estimates entering timing at which the recording medium enters into the second conveying unit, wherein the speed of the drive roller of the second conveying unit is controlled according to the entering timing.

3. The sheet conveying device according to claim 2, further comprising a first detecting unit that detects a length of the recording medium in the conveying direction, wherein the estimating unit and the first detecting unit estimates separation timing at which the recording medium separates from the second conveying unit, and the speed of the drive roller of the second conveying unit is controlled according to the separation timing.

4. The sheet conveying device according to claim 3, wherein the estimating unit serves as the first detecting unit.

5. The sheet conveying device according to claim 3, wherein the estimating unit estimates the entering timing based on any one of a drive signal and the speed information of the first conveying unit.

6. The sheet conveying device according to claim 3, further comprising a second detecting unit that is located on a conveying path through which the recording medium is conveyed, wherein the estimating unit estimates the entering timing based on a signal output from the second detecting unit.

7. The sheet conveying device according to claim 1, wherein at least one of the conveying units includes an endless belt that is stretched over the drive roller and moves with rotation of the drive roller.

8. The sheet conveying device according to claim 1, wherein the first conveying unit and the second conveying unit have an identical configuration.

9. The sheet conveying device according to claim 1, wherein the first measuring unit obtains speed information of the first conveying unit a plurality of times, and the calculating unit calculates the target value based on an average of the speed information.

10. The sheet conveying device according to claim 9, wherein a mode for calculating the target value is selectable from a first mode in which the calculating unit calculates the target value based on the speed information obtained by one-time measurement, and a second mode in which the calculating unit calculates the target value based on the speed information obtained by a plurality of times of measurement.

11. The sheet conveying device according to claim 1, wherein, when recording media of a type is sequentially conveyed, a target value calculated for a first recording medium is used as a target value for rest of the recording media.

12. The sheet conveying device according to claim 11, wherein a mode for calculating the target value is selectable from a first mode in which a target value is calculated for each of the recording media, and a second mode in which the target value calculated for the first recording medium is used as a target value for the rest of the recording media.

13. An image forming apparatus comprising a sheet conveying device that includes a plurality of conveying units each including a drive roller and a driven roller to convey a recording medium while holding the recording medium between the drive roller and the driven roller, the conveying units including a first conveying unit, that conveys the recording medium to an image transfer unit, and a second conveying unit, that transfer an image to the recording medium, the second conveying unit being located more than a sheet length of the recording medium downstream of the first conveying unit in a conveying direction in which the recording medium is conveyed, speed of the drive roller of the second conveying unit being controllable;

a first measuring unit attached to a shaft of the drive roller of the first conveying unit that obtains speed information of the first conveying unit;

a second measuring unit attached to a shaft of the drive roller of the second conveying unit that obtains speed information of the second conveying unit;

a storage unit that stores therein the speed information obtained from the first measuring unit when the recording medium enters the first conveying unit only when the measured speed falls below a threshold speed and the storage unit stores the speed information obtained from first measuring unit when the recording medium exits the first conveying unit only when the measured speed increases above the threshold speed;

a calculating unit that calculates a target value based on the speed information stored in the storage unit, and a controller that receives the speed information from the second measuring unit, wherein the speed of the drive roller of the second conveying unit is controlled based on the target value and the input speed information from the second measuring unit.

14. The image forming apparatus according to claim 13, further comprising:

a transfer unit that includes the second conveying unit; and a container that is configured to contain the recording medium, wherein the first conveying unit is located on a conveying path for conveying the recording medium from the container to the transfer unit.

15. The image forming apparatus according to claim 14, wherein the container is a bypass feed tray.

16. The image forming apparatus according to claim 13, further comprising:

a transfer unit that transfers an image onto the recording medium;

a fixing unit that includes the second conveying unit; and a container that is configured to contain the recording medium, wherein the first conveying unit is located on a conveying path for conveying the recording medium from the container to the transfer unit, or included in the transfer unit.

17. The image forming apparatus according to claim 13, further comprising:

a transfer-fixing unit that transfers and fixes an image onto the recording medium at a time, and includes the second conveying unit; and a container that is configured to contain the recording medium, wherein the first conveying unit is located on a conveying path for conveying the recording medium from the container to the transfer-fixing unit.

18. The image forming apparatus according to claim 17, wherein the container is a bypass feed tray.

19. The image forming apparatus according to claim 13, further comprising:

a transfer unit that transfers an image onto the recording medium;

a fixing unit that fixes the image to the recording medium; and a container that is configured to contain the recording medium, wherein the second conveying unit includes a first target conveying unit and a second target conveying unit, the transfer unit includes the first target conveying unit, the fixing unit includes the second target conveying unit, and the first conveying unit is located on a conveying path for conveying the recording medium from the container to the transfer unit.

20. The image forming apparatus according to claim 13, wherein a mode is selectable for conveying a thick recording medium, and only when the mode is selected, the speed of the drive roller of the second conveying unit is controlled.

* * * * *